United States Patent [19]

Dills

[11] Patent Number: 4,480,164

[45] Date of Patent: Oct. 30, 1984

[54] FOOD BROWNING SYSTEM INCORPORATING A COMBINED MICROWAVE AND HOT AIR OVEN

[75] Inventor: Raymond L. Dills, Louisville, Ky.

[73] Assignee: General Electric Company, Louisville, Ky.

[21] Appl. No.: 446,445

[22] Filed: Dec. 3, 1982

[51] Int. Cl.[3] ..... H05B 6/70

[52] U.S. Cl. ..... 219/10.55 B; 219/10.55 F; 219/10.55 R; 219/400; 126/21 A

[58] Field of Search ..... 219/10.55 R, 10.55 B, 219/10.55 F, 10.55 E, 400; 126/21 A, 21 R

[56] References Cited

U.S. PATENT DOCUMENTS

| | | | |
|---|---|---|---|
| 3,214,566 | 10/1965 | Wilson | 219/400 |
| 3,384,068 | 5/1968 | Perry et al. | 126/21 |
| 3,474,225 | 10/1969 | Leedy | 219/400 |
| 3,514,576 | 5/1970 | Hilton et al. | 219/400 |
| 3,984,578 | 10/1976 | Rohrl et al. | 426/523 |
| 4,029,463 | 6/1977 | Johansson et al. | 432/25 |
| 4,039,776 | 8/1977 | Roderick | 219/400 X |
| 4,071,738 | 1/1978 | Jenn et al. | 219/400 |
| 4,283,614 | 8/1981 | Tanaka et al. | 219/10.55 R |
| 4,332,992 | 6/1982 | Larsen et al. | 219/10.55 R |
| 4,354,083 | 10/1982 | Staats | 219/10.55 F |

FOREIGN PATENT DOCUMENTS 56-149531 11/1981 Japan ..... 126/21 A

OTHER PUBLICATIONS

"Double-Ended Oven Serves Two Presses", Product Engineering, Jan. 1945.

*Primary Examiner*—P. H. Leung

*Attorney, Agent, or Firm*—Frank P. Giacalone; Radford M. Reams

[57] ABSTRACT

A microwave oven browning system incorporating a combination microwave and hot air convection oven. The microwave cooking is carried out by use of a magnetron feeding a waveguide having a top branch on the top wall of the oven, a side branch on the side wall of the oven, and a bottom branch on the bottom wall of the oven. The convection cooking is carried out by directing heated air through a plurality of inlet openings in the top wall of the oven which are dimensioned to progressively increase in size in a downstream direction to ensure even distribution of heated air to the oven and a return air opening in the lower portion of the oven which ensures that air will flow over the top and bottom of food being cooked in the oven.

6 Claims, 4 Drawing Figures

FOOD BROWNING SYSTEM INCORPORATING A COMBINED MICROWAVE AND HOT AIR OVEN

BACKGROUND OF THE INVENTION

The present invention relates to microwave ovens having food browning capability and more particularly to an oven providing, in combination, a microwave heating energy system and a heated air circulating system.

Ovens are known which comprise an enclosed oven cavity to which microwave energy is supplied to be absorbed by foods placed in the cavity, thereby heating the food. One disadvantage of such microwave ovens when used for cooking food is that they do not always brown the surface of the food to an acceptable color, which in some instances may give the appearance of being undercooked by comparison with food cooked in ovens of the more traditional type.

Another known type of oven comprises an enclosed oven cavity through which air is circulated by a fan, the air being withdrawn from the cavity and then heated before being returned thereto. Ovens of this kind have the disadvantage that they take almost as long to cook a small amount of food as they do to cook the maximum amount of food which could be accommodated in the oven.

By contrast, the cooking time in a microwave oven is almost proportional to the amount of food in the oven, the cooking time for a fully charged microwave oven and a fully charged recirculating air oven of equal heating capacity being similar. On the other hand, a recirculating air oven which heats food by thermal conduction through its surface yields cooked food which is conventionally oven-browned.

It is, therefore, an object of the present invention to provide an oven which has the advantages of both the microwave oven and the recirculating air oven.

SUMMARY OF THE INVENTION

Briefly stated, the present invention provides a food cooking oven utilizing microwave heating energy and forced hot air heating. The oven comprises a top wall having an air circulating inlet, a rear wall, side walls wherein one of the side walls has an oven air circulating outlet positioned in the lower portion thereof. Positioned in the oven is a horizontally disposed food rack which is spaced from the bottom wall above the air circulating outlet of the oven cavity. Microwave energy is supplied by a magnetron positioned in a launch area through which microwave heating energy is introduced into the oven cavity through the upper and lower walls. Heated air is introduced into the oven cavity by an air circulating system which includes a housing positioned at the intersection of the top wall and the other side wall. The housing includes an air outlet and inlet. Connected to the outlet end of the housing is an air circulating passageway positioned on the top wall extending to the air circulating inlet in the top wall of the oven. A heater is arranged in the air circulating passages. Another air circulation passageway positioned on the other side wall is connected at one end to the inlet end of the housing and at its other end to the air circulating outlet in the side wall. Air-impelling means in the housing directs air into an air circulation passageway on the top wall of the oven into the cavity from which air is drawn through the outlet in the lower portion of the side wall, thereby establishing a forced recirculatory flow of heated air through the oven cavity, whereby food in the oven cavity is selectively exposed to microwave heating energy and heated recirculatory air.

DESCRIPTION OF THE PREFERRED EMBODIMENT

Figure 1:
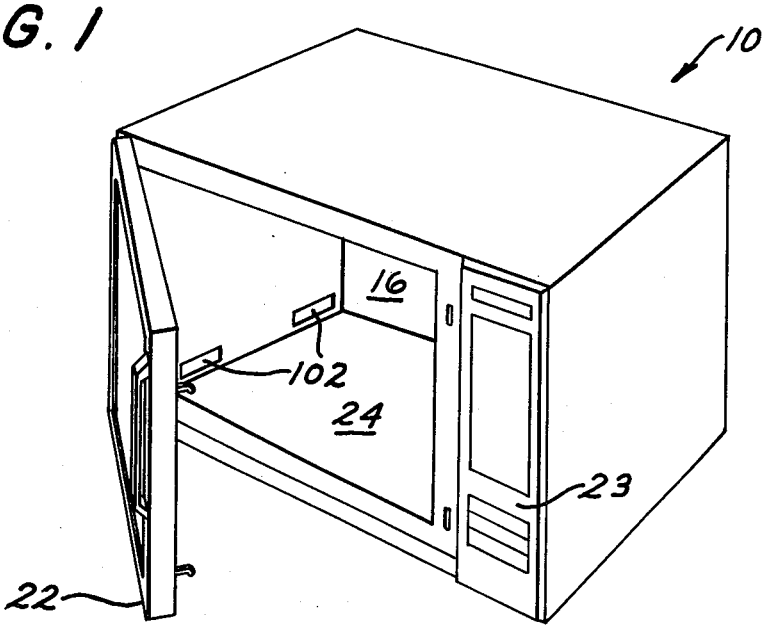
FIG. 1 is a front perspective view of a microwave oven.
Figure 4:
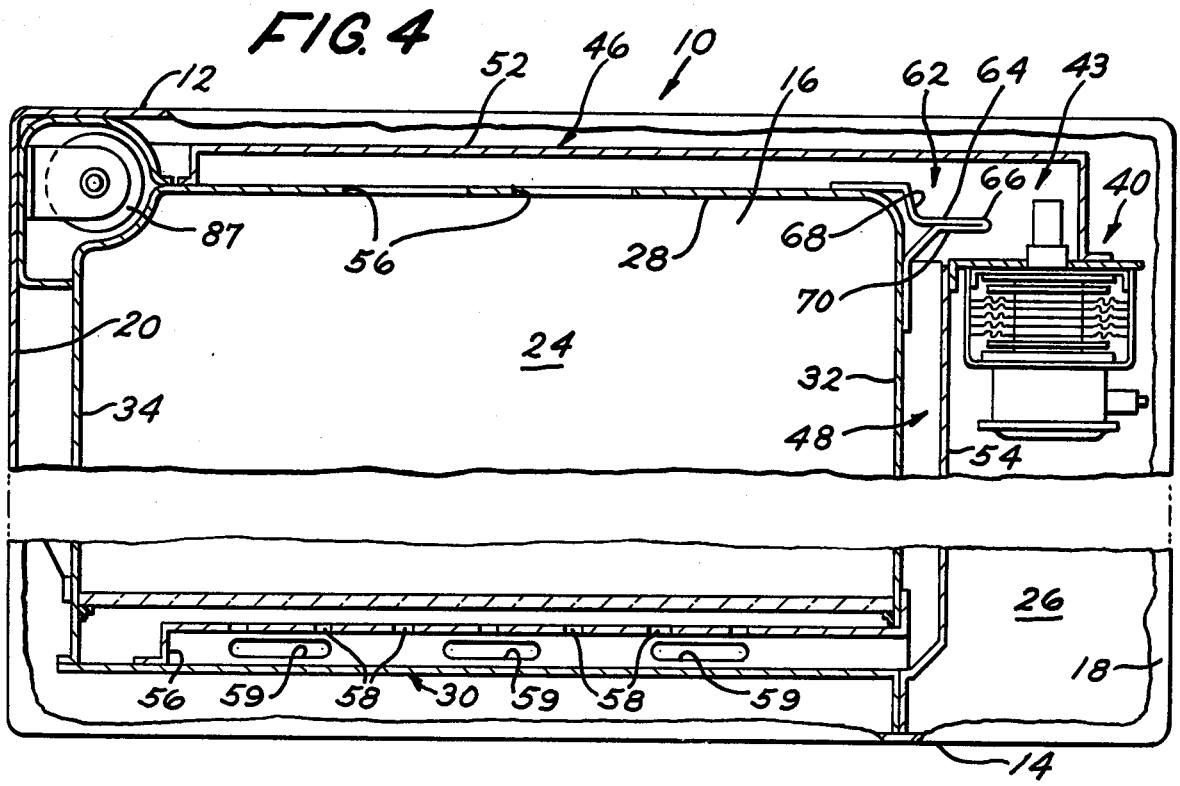
FIG. 4 is a front schematic sectional view similar to FIG. 3 taken along lines 4—4 of FIG. 2.

Referring to FIGS. 1 and 4, there is shown an oven designated generally 10 which includes a microwave heating energy system and a heated air circulation system. The oven comprises an outer cabinet formed with six walls including upper and lower walls 12 and 14, a rear wall 16, two side walls 18 and 20, a front wall partly formed by a hingedly supported door 22 and partly by control panel 23. The space inside the outer cabinet is divided generally into a cooking or oven cavity 24 and a control compartment 26. The cooking cavity includes a conductive top wall 28, a bottom wall 30, opposed side walls 32 and 34, and the rear wall which is the cabinet wall 16, and the front wall defined by the inner face of door 22.

A support plate 37 (FIGS. 3 and 4) defining the bottom wall of the cooking cavity is disposed in the lower region of cavity 24 substantially parallel to the bottom wall 30 of the cabinet and cavity. The support plate 37 provides the means for supporting food objects to be heated in the cavity 24 and defines a plane hereinafter referred to as the cooking cavity. A second food support shelf 38 is positioned in the cavity 24 which is used in conjunction with the employment of the heated air circulation system.

The source of microwave energy for cavity 24 is a magnetron 40 which is mounted in control compartment 26. Magnetron 40 has its output probe 42 positioned in a housing or launch area 43. It will be understood that numerous other components are required in a complete microwave oven, but, for clarity of illustration and description, only those elements believed essential for a proper understanding of the present invention as shown are described.

Microwave energy is fed from magnetron 49 to oven cavity 24 through a coupling or transmission means such as a waveguide having a horizontally extending top branch or section 46, a vertically oriented side branch or section 48 and a horizontally extending bottom branch or section 50. The upper waveguide branch 46 runs centrally of upper wall 28 of the cooking cavity and, as shown, is formed by elongated member 52 having a generally U-shaped cross section which is suitably attached to the top wall 28 of cooking cavity 24. As seen in FIG. 4, the waveguide 46 includes feed apertures 56 (FIGS. 3 and 4) located in wall 28, through which microwave energy is transmitted into the upper region of the cooking cavity 24. The waveguide section 46 extends beyond the cooking cavity in the direction of magnetron 40 to the housing 43, which serves as the launching area for microwave energy originating from probe 42.

The side waveguide 48 runs in a vertical direction centrally of the cooking cavity side wall 32 and serves to couple the microwave energy from magnetron 40 to bottom waveguide 50. Waveguide branch 48 is formed generally by the side wall 32 and an elongated member 54 having a generally U-shaped cross section and is suitably attached to the side wall 32.

The bottom waveguide section 50 runs horizontally across the center of the bottom wall 30 of the cooking cavity approximately underneath top waveguide section 46. At one end the waveguide is coupled to the side waveguide 48 and includes a short circuiting termination wall 56 adjacent its other end. The top wall of the bottom waveguide section 50 has a first set of slots 58 which are spaced apart along the length of section 50, and a second set of slots 59 provided in the side walls thereof.

Microwave energy from housing or launch area 43 in the vicinity or probe 42 of magnetron 40 is split between waveguide 46 and waveguides 48, 50 by a bifurcator 62 which operates to provide a stable power split between these waveguides. Bifurcator 62 is positioned at the junction of three waveguide sections comprising wave guides 46, 48, and launch area 43. The upper portion of bifurcator 62, comprising upper face 64 of horizontally extending divider 66 and step 68, functions as a quarter-wave transformer to efficiently match the impedance of guide section 46 to launch area 43 for maximum power transfer. To this end, the horizontal length for upper face 64 is a quarter-guide wavelength. The height of step portion 68 is chosen as a function of the height of guide section 46 and launch area 43 in accordance with conventional wave transformer design. The lower portion of bifurcator 62 provides a conventional mitered corner 70 for proper impedance matching with side waveguide 48.

In the illustrative embodiment, satisfactory cooking results are achieved by providing 60 percent of the energy to the top waveguide 46 and 40 percent to the bottom waveguide 50 via waveguide 48, which split is stabilized by bifurcator 62. It will be understood, however, that adequate performance could be achieved without bifurcator 62; recognizing that in such an arrangement there could be fluctuations in the power split as a function of the load presented by objects to be heated in the cavity. Also, it will be apparent that a ratio other than 60:40 could be achieved by proper adjustment of the configuration of bifurcator 62.

The microwave oven so far described, including the combination of upper and lower waveguide configuration, is fully disclosed in U.S. Pat. No. 4,354,083-Staats and in pending application Ser. No. 411,153-Bakanowski et al, filed Aug. 25, 1982, both assigned to the General Electric Company, the assignee of the present application.

By the present invention, a heated air circulating system is incorporated into the above-described microwave oven to enhance the browning characteristics of the oven and, accordingly, of the food. To this end, a heated forced air system is employed for recirculating heated air through the oven cavity. To this end, air circulating means including a blower assembly 76 is positioned at the intersection of upper wall 28 and side wall 34.

Figure 2:
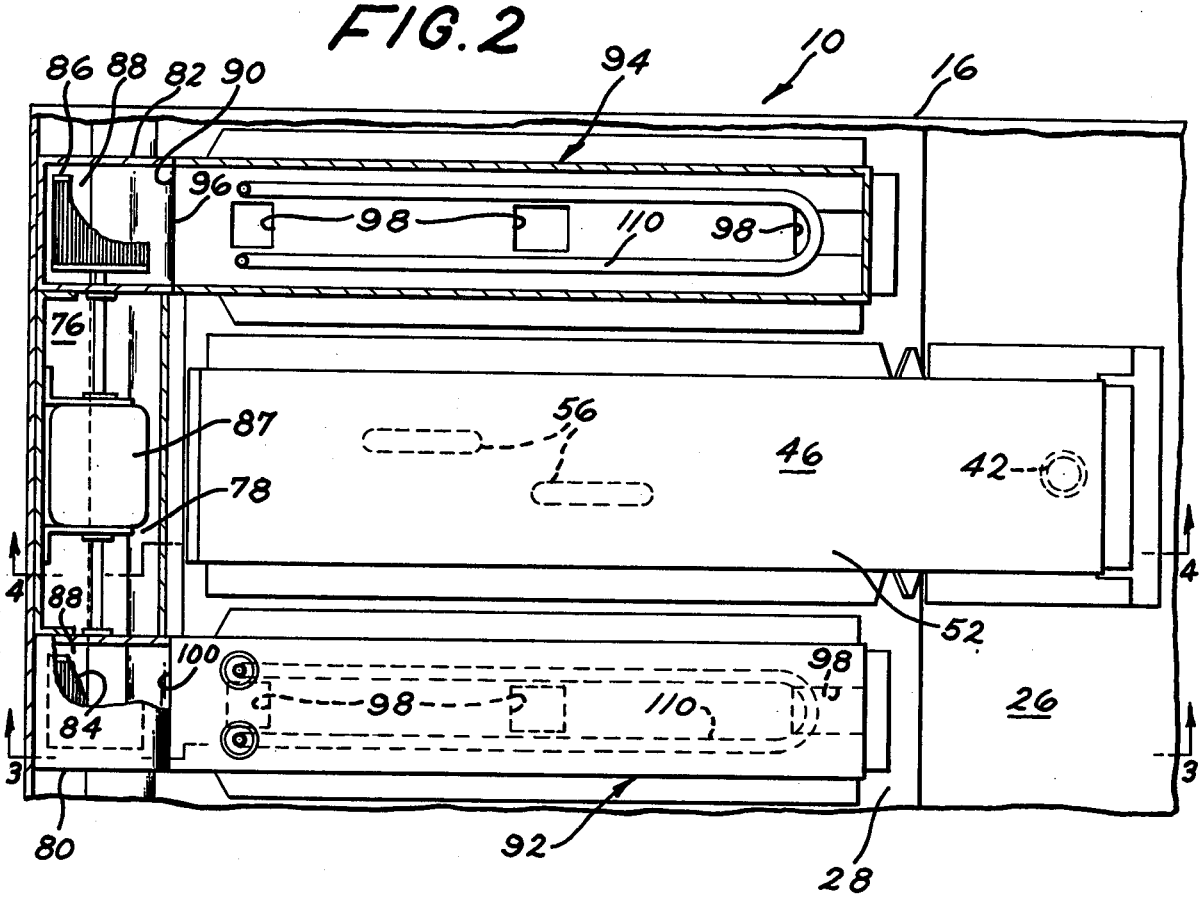
FIG. 2 is a plan view of the microwave oven showing the relationship of the waveguide and air circulating passageways.

To maintain the compact design of the oven while accommodating the blower assembly 76, the oven cavity at the intersection of top wall 28 and side wall 34 is drawn in toward the oven cavity to enlarge the area between the oven and cabinet in that location. This configuration provides an area between the oven and outer cabinet that accommodates the blower assembly 76 without changing the outer dimensions of the cabinet, while at the same time not affecting the usable cooking area of the oven cavity. The blower assembly 76, as best seen in FIG. 2, includes a central compartment 78 and a pair of end or outer housings 80 and 82. Positioned in housings 80 and 82 are blower wheels 84 and 86, respectively. The blower wheels are driven by a motor 87 positioned in compartment 78. Each of the housings 80 and 82 includes an air inlet 88 and an air outlet 90.

Figure 3:
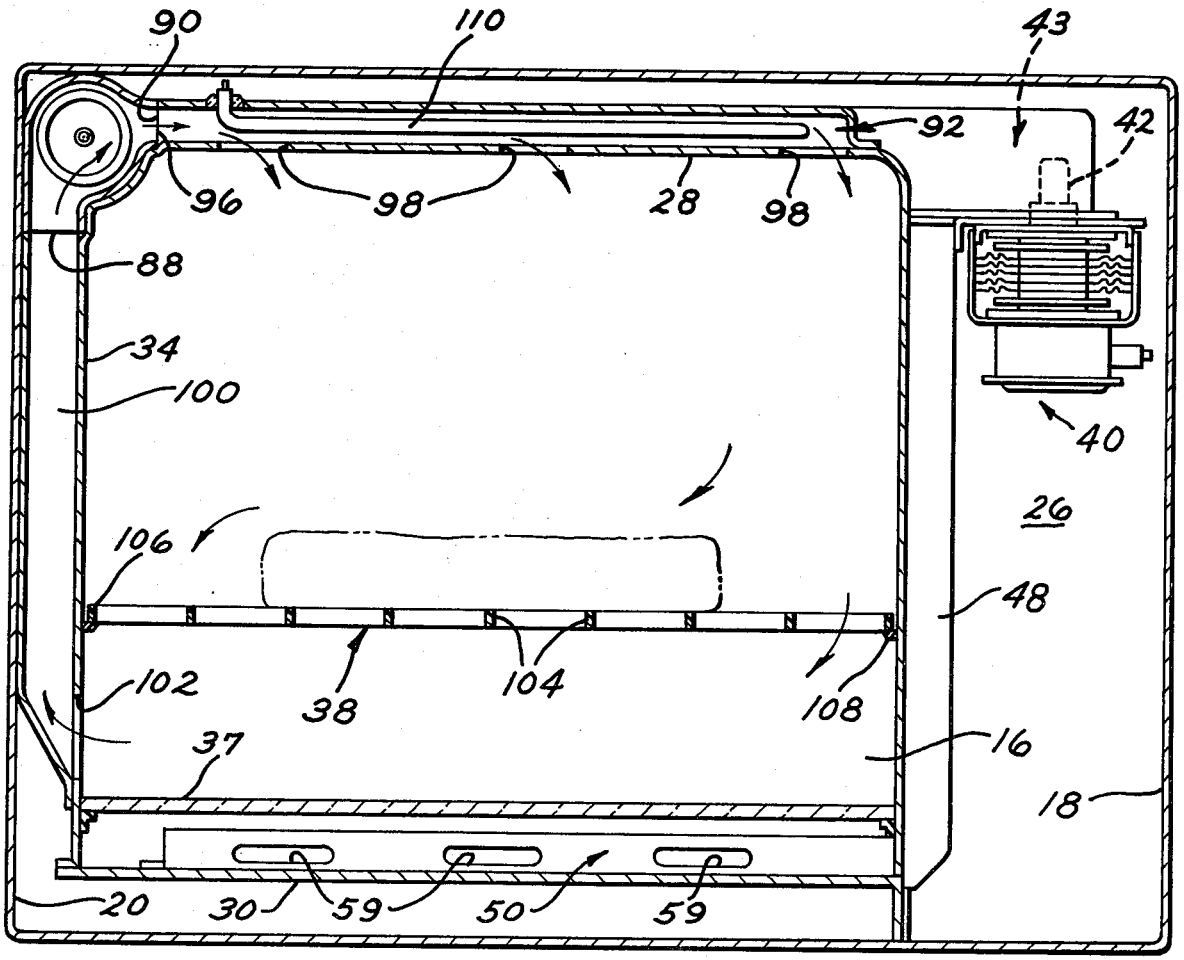
FIG. 3 is a front schematic sectional view of the microwave oven taken along lines 3—3 of FIG. 2.

Air is recirculated through the oven cavity 24 between the air outlet 90 and air inlet 88 by blowers 84, 86, respectively, in the following manner. Attached to the upper wall 28 of cavity 24 on either side of waveguide 46 and substantially parallel thereto is a pair of air circulating passageways 92 and 94. The passageways are made up of U-shaped section members attached to the flat upper wall 28 of cavity 24. As best shown in FIGS. 2 and 3, the passageways 92 and 94 extend generally between the side walls 32 and 34. One end of each of the passageways 92, 94 adjacent the side wall 32 is closed while the other ends adjacent side wall 34 are open to define air inlets 96 which are joined to the outlets 90 of blower housings 80, 82. The upper wall 28 within the dimensions of each passageway 92, 94 is provided with air circulating oven inlet openings 98. Air directed into the air passageways 92 and 94 by the blowers 84, 86, respectively, is conducted into the upper portion of oven cavity 24 through air inlet openings 98 formed in the upper wall 28. Air is discharged from the oven through air circulating oven outlet openings 102 formed in the lower portion of wall 34 and is returned to the blower assembly through a pair of passageways 100, positioned on the side wall 34 of cavity 24. Each of the passageways 100 is connected at one end to the corresponding inlets 88 of blower housings 80, 82, respectively, and at the other end to the oven air outlet openings 102.

Accordingly, air from blower assembly 76 flows through passageways 92, 94 into the upper portion of cavity 24 through the oven air inlet openings 98 and downwardly through the cavity. From the cavity 24, air passes through outlet openings 102, flows through passageway 100, and then back to the blower assembly 76 to be recirculated. In order to insure a relatively uniform temperature distribution, it is necessary that the heated air recirculating therethrough be evenly distributed with all areas of the cavity receiving substantially the same amount of air. To this end, the area of the openings 98 in top wall 28 increases as they approach the wall 32. This configuration insures that the volume of air passing through all of the openings 98 is substantially the same.

As mentioned above, the shelf 38 is used in conjunction with the heated air circulation system. The shelf 38, as best seen in FIG. 3, is positioned in the oven cavity 24 so as to be above the outlet openings 102 in side wall 34. This arrangement of shelf 38 relative to the outlet opening 102 insures that the food to be cooked is in the path of the recirculating air and that the air scrubs all surfaces of the food placed on the shelf 38. To further insure the free circulation of air over the food, the shelf 38 may be constructed of a plurality of cross bars or members 104 secured to an outer frame 106 which engage support members 108 secured to side walls 32 and 34 of the oven.

In accordance with the present invention, the recirculated air is employed to enhance the food browning characteristics of the microwave oven, and, accordingly, the air recirculating through the oven cavity 24 is heated to a temperature sufficient to provide an effective and relatively fast browning system. Within each of the air circulation passageways 92 and 94 thus defined are disposed heating elements or resistance heaters 110. The wattage of heating elements 110 must be sufficient to insure that the temperature of the air recirculating through the oven cavity 24 is heated to a predetermined level and the temperature in the oven cavity maintained at a desired food browning temperature range. If necessary, a temperature sensor may be employed to control the energization of the heaters and, accordingly, the temperature of the oven cavity.

When cooking, and more particularly to insure even browning of certain foods such as those having substantial bulk and moisture content, and also the type utensil the food is placed in may to a certain degree lengthen the time it takes to cook and brown the bottom portion of the food, it may be desirable to increase the amount of microwave energy directed to the bottom waveguide 50 relative to the energy directed to the top waveguide 46. To this end, the extending divider portion 66 of the bifurcator 62 may be fabricated so that it is deflectable or movable relative to waveguides 46 and 48. By adjusting the position of deflector portion 66 of the bifurcator relative to the waveguides 46 and 48, the ratio of microwave energy to the top and bottom waveguides can readily be varied to suit the specific requirements of the food to be cooked and browned on shelf 38.

This combination of microwave energy applied through waveguides 46 and 50 to the upper and lower portions of the oven cavity together with the recirculating relatively warm air through the oven cavity will subject all food surfaces placed on shelf 38 to the same air temperature. This relatively uniform temperature distribution and heating effect of the recirculating air combined with the speed of microwave cooking results in a small moisture loss and even browning of the food.

It should be apparent to those skilled in the art that the embodiment described heretofore is considered to be the presently preferred form of this invention. In accordance with the patent statutes, changes may be made in the disclosed apparatus and the manner in which it is used without actually departing from the true spirit and scope of this invention.

What is claimed is:

1. A food cooking oven utilizing microwave heating energy and forced hot air heating means comprising:

an oven cavity including a top wall having a plurality of air circulating inlet openings, a rear wall, side walls wherein one of said side walls has an air circulating outlet opening positioned in the lower portion thereof, and an access front opening;

a horizontally disposed food rack within said oven cavity being supported on said side walls spaced from said bottom wall above said air circulating outlet in said one of said side walls;

generator means operable for supplying microwave heating energy into said oven cavity;

a housing means positioned at the intersection of said top wall and said one of said side walls including an outlet adjacent said top wall;

an air circulation passageway on said top wall extending from said housing to a position enclosing said plurality of air circulating inlet openings in said top wall;

said plurality of air circulating inlet openings being arranged in a row in said air circulating passageway being dimensioned to progressively increase in cross-sectional area in a downstream direction with the smallest inlet opening located adjacent said housing outlet so that air flow through said inlet openings is substantially equal across the upper portion of said oven cavity;

a heater arranged in said air circulation passageway for heating air passing therethrough;

an inlet air circulation passageway on said one of said side walls extending from an inlet to said housing to said air circulation outlet opening in a position below said food rack in said one of said side walls;

air impelling means in said housing for directing air into said air circulation passageway over said heater and through said plurality of air circulating inlet openings in said top wall of said oven cavity, and for drawing air into said inlet air circulation passageway through said air circulating outlet opening in the lower portion of said one of said walls in said oven cavity to thereby establish a forced recirculatory flow of heated air through said oven cavity between said air circulating inlet openings in said top wall and said air circulating outlet opening in said one of said side walls below said food rack whereby food in said oven cavity is exposed to said microwave heating energy and said heated recirculated air from above and below said food rack.

2. The food cooking oven recited in claim 1 wherein said generation means is coupled to a first waveguide positioned centrally on said top wall extending from said generator means for supplying microwave energy to said cavity from above said food rack, and a second waveguide positioned centrally on said bottom wall extending along the other of said side walls to said generator means for supplying microwave energy to said cavity from below said food rack.

3. The food cooking oven recited in claim 2 wherein there are two said air circulation passageways, each of said air circulation passageways being positioned on each side of said first waveguide, and said air impelling means directs air through each of said air circulation passageways simultaneously.

4. The food cooking oven recited in claim 3 further including means for controlling respective amounts of microwave heating energy to said first waveguide and said second waveguide.

5. A food cooking oven utilizing a microwave heating energy system and a forced hot air heating system comprising:

an oven cavity including a top wall, a rear wall, side walls and an access front opening;

a horizontally disposed food rack formed to provide substantially unrestricted air flow therethrough, means supporting said rack within said oven cavity in spaced relationship with said bottom wall;

said microwave heating energy system including:

generator means operable for supplying microwave heating energy into said oven cavity;

a microwave launch area for said microwave heating energy positioned at the intersection of said top wall and one of said side walls, said top wall being formed to include waveguide slots;

a first waveguide positioned centrally on said top wall extending from said launch area to said waveguide slots in said top wall for supplying microwave energy to said cavity from above said food rack;

a second waveguide extending downwardly from said launch area along said one of said side walls and said bottom wall for supplying microwave energy to said cavity from below said food rack; and said generator means including a probe in said launch area being operable for supplying microwave heating energy to the upper and lower portions of said oven cavity through said waveguides;

said forced hot air heating system including:

a housing means positioned at the intersection of said top wall and the other of said side walls including an outlet adjacent said top wall;

said oven cavity including a plurality of air circulating inlet openings in said top wall and an air circulating inlet opening in the other of said side walls being positioned below said food rack;

an outlet air circulation passageway on said top wall extending from said housing to a position enclosing said plurality of air circulating inlet openings in said top wall;

said plurality of air circulating inlet openings being arranged in a row in said air circulating passageway being dimensioned to progressively increase in cross-sectional area in a downstream direction with the smallest inlet opening located adjacent said housing outlet so that air flow through said inlet openings is substantially equal across the upper portion of said oven cavity;

a heater arranged in said air circulation passageway for heating air passing therethrough;

an inlet air circulation passageway on said other of said side walls extending from said housing to said air circulation outlet opening in said other of said side walls; and air impelling means in said housing for directing air into said outlet air circulation passageway over said heater and through said plurality of air circulating inlet openings in said top wall of said oven cavity, and for drawing air into said inlet air circulation passageway from said air circulating outlet opening in the lower portion of said other of said walls in said oven cavity to thereby establish a forced recirculatory flow of heated air through said oven cavity between said air circulating inlet openings in said top wall and said air circulating outlet opening in said other of said side walls below said food rack whereby food on said rack in said oven cavity is exposed to said microwave heating energy and said heated recirculated air.

6. The food cooking oven recited in claim 5 further including means for controlling respective amounts of microwave heating energy to said first waveguide and said second waveguide.

* * * * *